United States Patent [19]

Goodfellow

[11] Patent Number: 4,462,238

[45] Date of Patent: Jul. 31, 1984

[54] METHOD FOR CONTROLLING PROPERTIES OF METALS AND ALLOYS

[75] Inventor: Glenn B. Goodfellow, Wyckoff, N.Y.

[73] Assignee: UTI Corporation, Collegeville, Pa.

[21] Appl. No.: 451,136

[22] Filed: Dec. 20, 1982

[51] Int. Cl.[3] ..... B21D 22/00

[52] U.S. Cl. ..... 72/358; 72/352; 72/360; 72/438

[58] Field of Search ..... 72/352, 358, 359, 354, 72/360, 438

[56] References Cited

U.S. PATENT DOCUMENTS

| | | | |
|---|---|---|---|
| 2,169,113 | 8/1939 | Sheppard | 72/453.08 |
| 3,167,859 | 2/1965 | Bailey | 72/352 |
| 3,209,453 | 10/1965 | Bertoglio et al. | 72/354 |
| 3,832,763 | 9/1974 | Schober | 29/159.2 |
| 4,045,644 | 8/1977 | Shafer et al. | 219/119 |

*Primary Examiner*—Leon Gilden

*Attorney, Agent, or Firm*—Seidel, Gonda & Goldhammer

[57] ABSTRACT

A method for increasing strength and/or hardness of a preshaped metal specimen by cold working is disclosed. Compressive force is applied to the specimen slowly so that the yield strength of the specimen progressively increases and the specimen exhibits squirming instability as its diameter increases.

13 Claims, 19 Drawing Figures

FIG. 1
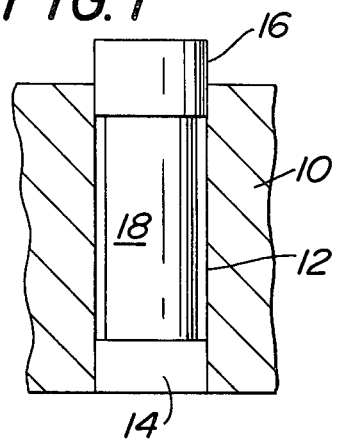
FIG. 2
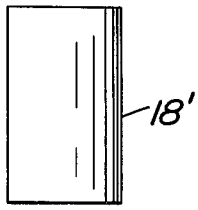
FIG. 3
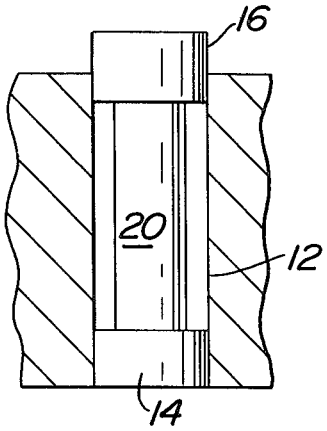
FIG. 4
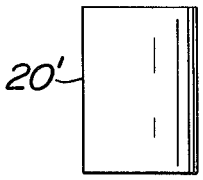
FIG. 5
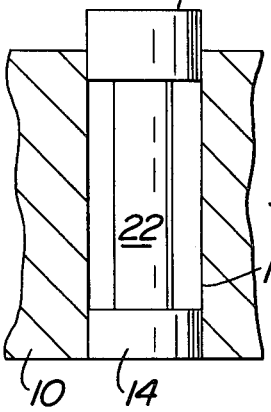
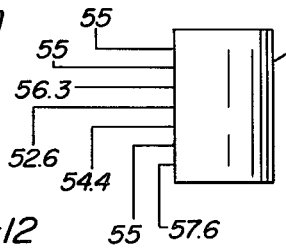
FIG. 6
FIG. 7
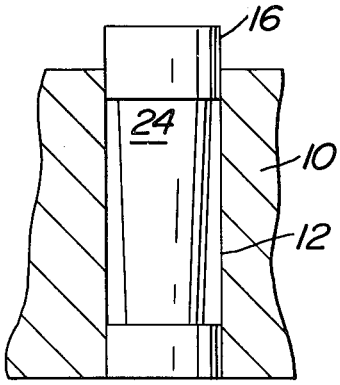
FIG. 8
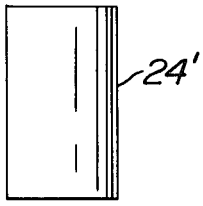

FIG. 9
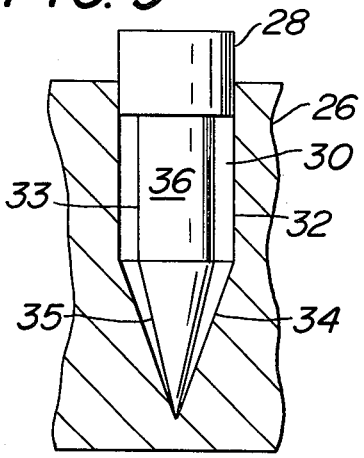
FIG. 10
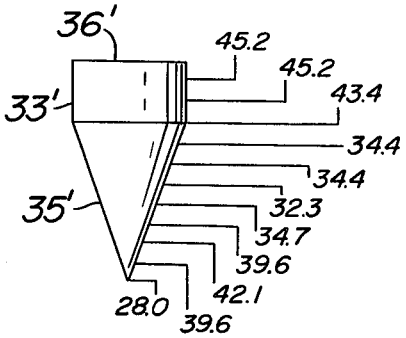
FIG. 11
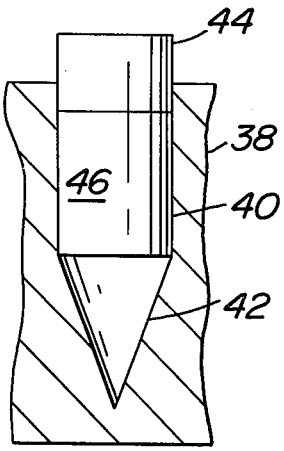
FIG. 12
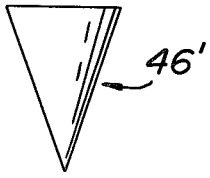
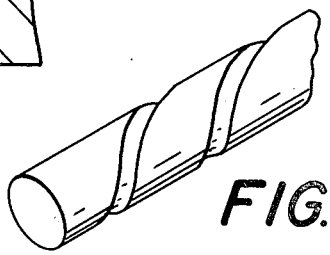
FIG. 19
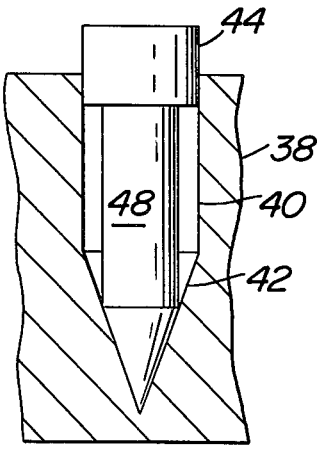
FIG. 13
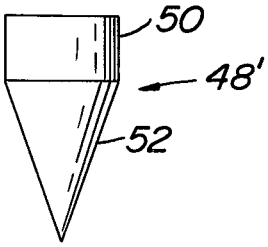
FIG. 14

FIG. 15
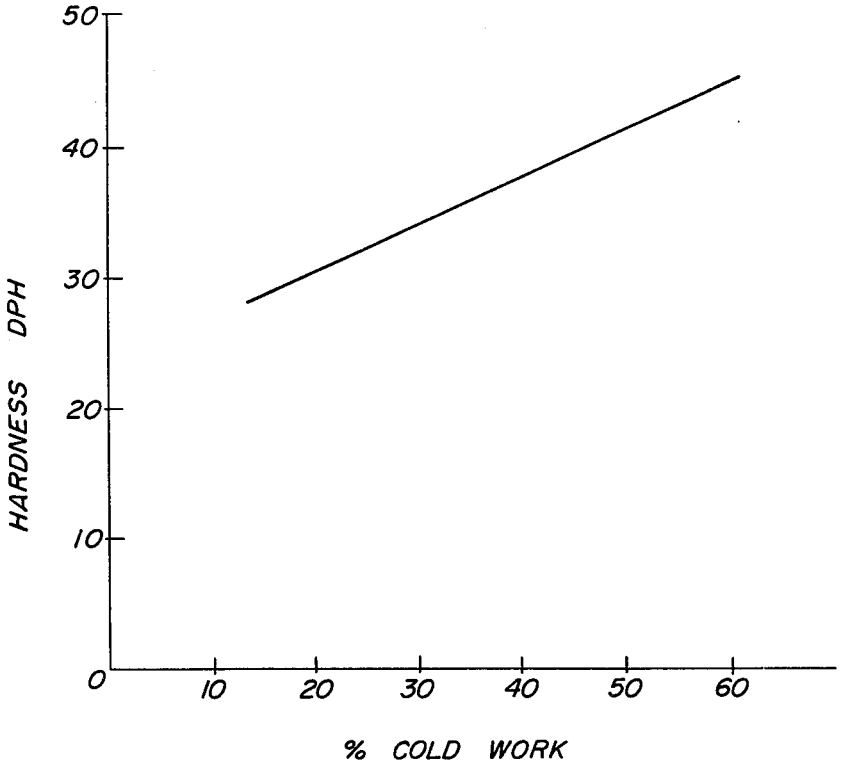
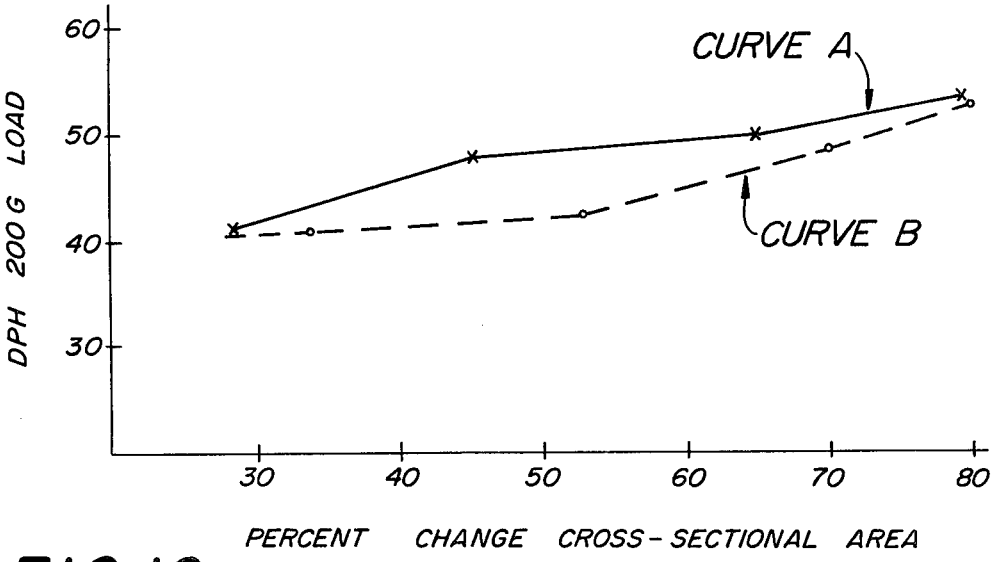
FIG. 16

FIG. 17
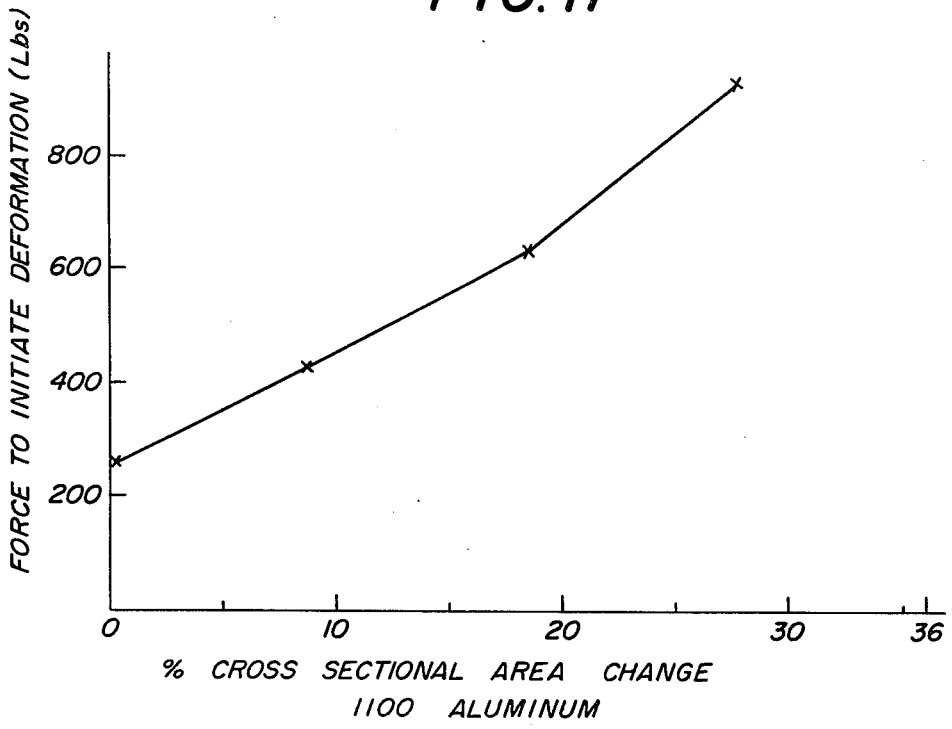
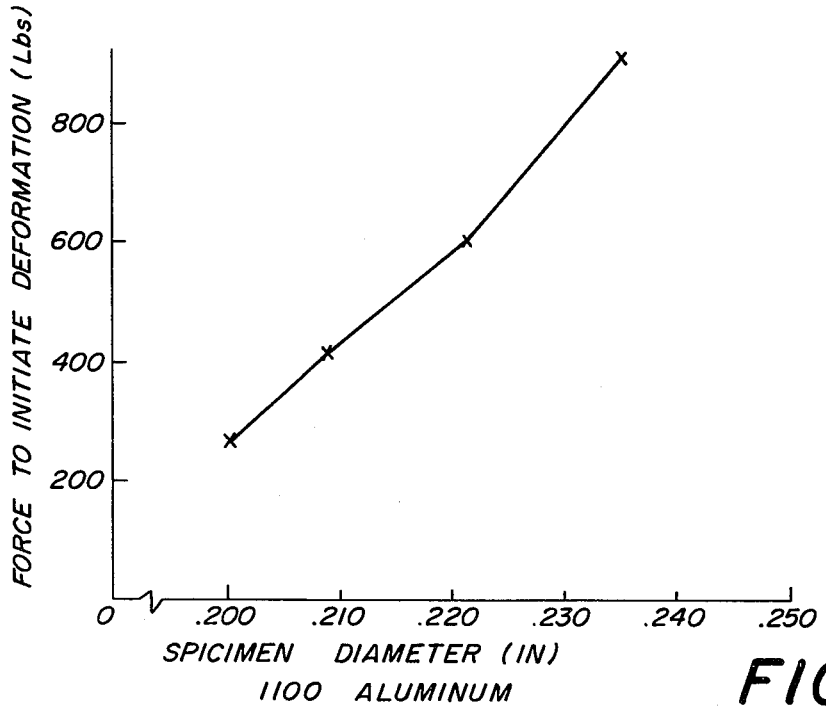
FIG. 18

METHOD FOR CONTROLLING PROPERTIES OF METALS AND ALLOYS

BACKGROUND OF THE INVENTION

It is old and well known in the art of metal working to cold work metals and alloys. It is known from U.S. Pat. No. 3,209,453 to shape a blank in a die prior to finish machining. It is known from U.S. Pat. No. 4,045,644 to apply axial pressure on a sintered electrode blank to pressure flow the blank radially to reorientate the grain structure.

It would be highly desirable if one could control mechanical properties of metals in a predictable manner so as to attain, for example, a metal product having predetermined variable hardness along its entire length or along only a portion of its length. The present invention is directed to attaining that goal.

SUMMARY OF THE INVENTION

The present invention is directed to a method for increasing strength and/or controlling mechanical properties of metals and alloys in a predictable manner. A specimen is produced with a preshape and dimensions determined on the basis of the desired strength or mechanical properties with the specimen length being substantially greater than the transverse dimensions. The preshaped specimen is introduced into a confined chamber which defines the desired final shape. At least a portion of the specimen is spaced from the periphery of the walls defining the chamber with the relative dimensions of the spacing being governed by the amount of cold work needed to achieve desired strength or mechanical properties in that portion of the specimen.

One face of the specimen is engaged with a moveable wall of the chamber. The moveable wall of the chamber applies a continuous compressive force with a sufficient magnitude so as to force the preshaped specimen to deform and fill the chamber at the end of the compressive stroke while simultaneously decreasing length and maintaining the volume of the specimen constant. The compressive force is applied sufficiently slowly so that the yield strength of the preshaped specimen progressively increases. At the same time, the compressive force progressively increases as the yield strength increases until the entire circumference of the specimen contacts the walls of the chamber and attains said desired final shape at the end of the compressive stroke.

It is an object of the present invention to provide a method for controlling the strength and/or mechanical properties of metals and alloys by cold working a preformed specimen in a closed chamber.

It is another object of the present invention to provide a method for predictably controlling mechanical properties such as hardness along the length or breath of a specimen.

Other objects and advantages will appear hereinafter.

DESCRIPTION OF THE DRAWINGS

FIG. 1 is a sectional view of a closed die containing a specimen.

FIG. 2 is an elevation view of the specimen in FIG. 1 after it has been shaped.

FIG. 3 is a sectional view of a closed die containing another specimen.

FIG. 4 is an elevation view of the specimen in FIG. 3 after it has been shaped.

FIG. 5 is a sectional view of a closed die containing another specimen.

FIG. 6 is an elevation view of the specimen in FIG. 5 after it has been shaped.

FIG. 7 is a sectional view of a closed die containing another specimen.

FIG. 8 is an elevation view of the specimen in FIG. 7 after it has been shaped.

FIG. 9 is a sectional view of a closed die containing another specimen.

FIG. 10 is an elevation view of the specimen in FIG. 9 after it has been shaped.

FIG. 11 is a sectional view of a closed die containing another specimen.

FIG. 12 is an elevation view of the specimen in FIG. 11 after it has been shaped.

FIG. 13 is a sectional view of a closed die containing another specimen.

FIG. 14 is an elevation view of the specimen in FIG. 13 after it has been shaped.

FIG. 15 is a graph of hardness versus percent cold worked.

FIG. 16 is a graph of hardness versus percent change of cross-sectional area.

FIG. 17 is a graph of force versus specimen diameter.

FIG. 18 is a graph of force versus percent cross-sectional area change.

FIG. 19 is a perspective view of a specimen showing squirming instability.

DETAILED DESCRIPTION

Referring to the drawing in detail, wherein like numerals indicate like elements, there is shown in FIG. 1 a portion of a press 10 having a confined chamber 12 defined at its ends by walls 14 and 16. At least one of the walls, such as wall 16 is moveable toward and away from the wall 14. Within the chamber 12, there is provided a specimen 18 of a metal to be cold worked. The specimen 18 may be aluminum, low carbon steel, alloys or other metals.

The specimen 18 is preformed with a cylindrical shape. The chamber 12 defines the desired peripheral final shape for the specimen and likewise in this embodiment is a cylinder. Wall 16 engages one end face of the specimen 18 which is at room temperature and applies a continuous compressive force with a sufficient magnitude to force the preshaped specimen 18 to deform and fill the chamber 12 at the end of the compressive stroke. The specimen 18 simultaneously decreases length while maintaining its volume so as to have a final shape as shown in FIG. 2 and designated 18'. The compressive forces of wall 16 are applied sufficiently slowly so that the yield strength of the specimen 18 progressively increases. This in turn requires the compressive forces to progressively increase in magnitude as the yield strength increases until the entire circumference of the specimen 18 contacts the walls of chamber 12 and attains the desired final shape at the end of the compressive stroke as shown in FIG. 2.

In virtually every engineering design problem encountered in real life situations, engineers and scientists strive for designs that preclude loading of columns or columnar type structures to levels where buckling can occur. Such column buckling has been well-known for 200 years.

Mathematical criteria for column buckling was first developed by L. Euler in 1744, and the governing equation has since been known as the Euler equation. It states simply that a column must attain a certain length before it can be bent by its own or an applied weight.

The Euler formula has withstood the test of time. Originally it was stated as (1)

$$FL^2 > 4\pi^2 B,$$

where

F=load in pounds (lbs.)

L=length in inches

B=Flexural rigidity=EI(Lb-in$^2$), where

E=Youngs Modulus of elasticity (Lb/in$^2$)

I=Moment of inertia about the axis of bending (in$^4$).

(1) A.E.H. Love, Mathematical Theory of Elasticity, Dover Publications 1974.

In its present day form, the equation (2) is given as $$W_{CR} = K_C \frac{EI}{L^2}$$

where $W_{CR}$=Critical Load beyond which buckling will occur, and $K_C$=is a constant which depend upon the manner of support and loading.

In fact, the value of $K_C$ for clamped or supported end conditions with axial load is given (2) as 39.48 which is exactly equal to $4\pi^2$, so that $$W_{CR} = 4\pi^2 \frac{EI}{L^2}$$

is exactly the Euler equation.

(2) Alexander Blake, Practical Stress Analysis in Engineering Design, Marcel Dekker, Inc. 1982.

It is a fact emphasized in the literature that the critical buckling load $W_{CR}$ is proportional to the Modulus of Elasticity E, section moment of inertia I, and inversely proportional to column length squared $1/L^2$, and is independent of yield strength of the material. It is further emphasized that critical buckling occurs at stress below uniaxial yield stress values.

I uniquely found that the amount of deformation force necessary to achieve the desired final geometry, and thus mechanical properties, can be achieved by exploiting those elements of column buckling which Engineering text books define as the forbidden zones. For example, an aluminum specimen with initial diameter of 0.15 inches, was placed in the press and compressive force applied axially. After compressing approximately 25% of the total deformation, it was found that deformation was not uniform compression. Rather, deformation occurred by apparent buckling until the die wall restraint was encountered after which the specimen continued to deform in a spiral-like fashion with quite uniform pitch from end to end. See FIG. 19. Final deformation occurred by compressive stress. For ease of reference, I define this spiral deformation cycle as squirming instability followed by compression until final geometry is achieved.

In a typical example, specimen 18 was made from 1100 aluminum with a length of 1 inch and a diameter of 0.2 inches, and the specimen 18' had a length of 0.635 inches and a diameter of 0.251 inches. Hardness varied along the length of the specimen 18' with the hardness progressing from about 51 DPH (diamond point hardness) at its ends to about 47 DPH at its middle.

In FIG. 3, there is illustrated a different specimen 20 in the chamber 12. Specimen 20 was smaller in diameter than specimen 18 and formed the specimen 20' after compression and cold working. The effect on hardness was substantially the same as that attained in connection with FIGS. 1 and 2. However, as the percentage of cold working increased, the hardness likewise increased. See FIG. 15.

In FIG. 5 there is shown a similar specimen 22 in the chamber 12. The diameter of specimen 22 was smaller than the diameter of specimens 18 and 20. After compression, the resultant specimen 22' had hardnesses varying along its length as indicated in FIG. 6. Specimen 22 had a nominal length of 1 inch and was reduced so that specimen 22' had a length of 0.367 inches. The diameter of specimen 22 was 0.15 inches and increased whereby specimen 22' had a diameter of 0.251 inches.

The specimen need not be cylindrical. Different effects are attained as the shape of the specimen varies. As shown in FIG. 7, when a specimen 24 in the form of a truncated cone is compressed in chamber 12, the resultant specimen 24' is a cylinder but its hardness progressively increases in a direction from its upper end to its lower end in FIG. 8.

In FIG. 9, there is shown a similar press 26 having movable wall 28 and a confined chamber 30. Chamber 30 has a cylindrical portion 32 and a tapered portion 34. The specimen 36 has a cylindrical portion 33 and a tapered portion 35. The length of tapered portion 34 of the chamber corresponds to the length of the tapered portion 35 of specimen 36. After compression, the specimen 36' had hardness values as indicated in FIG. 10.

Typical dimensions of specimens 36, 36' are as follows. Specimen 36 had a diameter of 0.2 inches at its cylindrical portion 33 and a length of 0.75 inches. The tapered portion 35 of the specimen 36 had a length of 0.75 inches. The tapered portion 35' of specimen 36' had a length of 0.375 inches and a diameter of 0.251 inches. The length of the tapered portion 35' of the specimen 36' was 0.688 inches. It will be noted that the hardness of the cylindrical portion 33' of specimen 36' remains substantially constant while the hardness of the tapered portion 35' thereof varies by decreasing, increasing, and then decreasing toward the apex where the minimum amount of cold working occurred and hence the minimum hardness. In connection with FIGS. 9 and 10, it was noted that all diameters increased the same percentage during compression.

In FIG. 11, the press 38 has a chamber defined by cylindrical portion 40 and conical portion 42. The chamber is closed by a movable wall 44. Within the cylindrical portion 40, there is provided a specimen 46 of 1100 aluminum having substantially the same diameter. The cold working of specimen 46 converted it into the conical specimen 46'. Hardness varied along the length of the specimen 46'. At the base of the cone, the hardness of the specimen 46' is substantially the same as the original hardness of the specimen 46. Maximum hardness occurred at the apex of the specimen 46'. Since the hardness at the base of the cone of specimen 46' is substantially the same as the original hardness of specimen 46, specimen 46' may easily be metallurgically bonded to any other device such as a rod from which specimen 46 was cut.

As shown in FIG. 13, a specimen 48 has been substituted for the specimen 46 in the press 38. Specimen 48 is a cylinder of 1100 aluminum having a length greater than the length of the cylindrical portion 40 and having flat parallel ends. The diameter of the cylindrical specimen 48 is substantially less than the diameter of cylindrical portion 40. After compression, there is formed specimen 48' having a cylindrical portion 50 and a tapered portion 52. The tapered portion 52 conforms to the shape of the tapered portion 42 of the chamber while the cylindrical portion 50 conforms to the shape of the cylindrical portion 40 of the chamber. The hardness along cylindrical portion 50 of specimen 48' is uniform and greater than that of specimen 48 while the hardness of conical portion 52 increased from the apex toward the cylindrical portion 50.

FIG. 16 is a graph of hardness versus percent change of cross-sectional area. Curve A represents the specimen 46' and Curve B represents the specimen 48'. The specimens were cut in half and the hardness readings were taken along the longitudinal axis. It will be noted that the curves are very close to one another and on the basis of statistical averages could be shown as straight lines. FIG. 16 illustrates a predetermined relationship between hardness and percent change in cross-sectional area.

FIG. 17 illustrates the relationship between force to initiate deformation versus the percent cross-sectional area change which is a measure of the amount of cold work. As the percent cross-sectional area change increases, the force to initiate deformation progressively increases. FIG. 18 illustrates that the force to initiate deformation progressively increases as the specimen diameter increases. The latter is directly correlated to the yield strength of the specimen.

Test results have shown that there is no difference if only one of both of the walls at opposite ends of the chamber move. The rate of forming was not a significant factor. Substantially identical results were attained when the specimen was offset with respect to the axis of the chamber as opposed to being disposed along the axis of the chamber. In all cases, the hardness increased in proportion to cold working as shown in FIG. 15.

The present invention facilitates variation in the hardness in a predetermined manner at a predetermined location along the length of the specimen. No special tooling is required for practicing the present invention. Thus, the invention may be practiced on a conventional 75 ton single action hydraulic press having a split die to facilitate removal of the finished part. The present invention can more efficiently and economically perform functions which were attained heretofore by swaging while attaining features which cannot be attained by swaging such as excellent surface finish, no scrap, closely controlled diameter and length, producing bars with a a hardcore and a soft exterior, producing bars which are conical with uniform properties, etc.

The procedure for production of a simple cylinder such as specimen 18' is as follows. Determine the desired compressed size as defined by $D_2$ and $L_2$. From a graph of $D_1/D_2$ versus ultimate tensile strength, select D1 as required. Calculate $L_1$ from the constant volume formula:

$$L_1 = \frac{L_2(D_2)^2}{(D_1)^2}$$

Then, machine the specimen to $D_1$ and $L_1$. Then compress the specimen in a closed chamber as described above.

Thus, the present invention facilitates custom designing of the cold working of metals to a pre-determined hardness while simultaneously increasing its ultimate tensile strength and decreasing its percent elongation. The rate of movement of the movable wall 16 may vary as desired depending upon the hardness of the materials involved. Typical speed of movement of wall 16 is in the range of 0.05 inches to 50 inches per minute. Most metals can be processed at a rate of 3 to 10 inches per minute.

The present invention may be embodied in other specific forms without departing from the spirit or essential attributes thereof and, accordingly, reference should be made to the appended claims, rather than to the foregoing specification, as indicating the scope of the invention.

I claim:

1. A method for increasing strength and/or controlling mechanical properties of metals and alloys comprising (a) producing a metal specimen with a preshape and dimensions determined on the basis of the desired strength or mechanical properties, (b) introducing said preshaped specimen into a confined chamber which defines and desired peripheral final shape, spacing at least a portion of the periphery of said preshaped specimen from at least a portion of the walls defining said chamber with the relative dimensions of the spacing being governed by the amount of cold work needed to achieve desired strength or mechanical properties in that portion of the specimen, (c) engaging one face of said specimen with at least one moveable wall of said chamber and applying a continuous compressive force by said wall with a sufficient magnitude to force the preshaped specimen to deform and fill the chamber at the end of the compressive stroke while simultaneously decreasing length and maintaining the volume of the specimen constant, and (d) applying said compressive force by moving said moveable wall of the chamber sufficiently slowly so that the yield strength of the specimen progressively increases, and progressively increasing the magnitude of said force as the yield strength increases until the entire circumference of the specimen contacts the walls of the chamber and attains said desired final shape at the end of the compressive stroke of said movable wall.

2. A method in accordance with claim 1 including using a pre-shaped specimen whose length is substantially greater than its transverse dimensions.

3. A method in accordance with claim 1 including using a specimen which at least in part is non-cylindrical.

4. A method in accordance with claim 1 including using a confined chamber which at least in part is conical.

5. A method in accordance with claim 1 including deforming the specimen so that all transverse dimensions increase by the same percentage during compression.

6. A method in accordance with claim 5 wherein the speed of the movable wall is sufficiently slow as to cause the specimen to exhibit squirming instability as it increases in transverse dimensions.

7. A method in accordance with claim 1 wherein the speed of the movable wall is in the range of 3 to 10 inches per minute.

8. A method in accordance with claim 1 wherein the speed of the movable wall is sufficiently slow as to cause the specimen to exhibit squirming instability as it increases in transverse dimensions.

9. A method in accordance with claim 1 including retaining substantially the original hardness at one end of the specimen.

10. A method in accordance with claim 1 where step (a) is performed in a manner so that steps (c) and (d) produce a specimen whose hardness varies along its length in a predetermined range.

11. A method in accordance with claim 1 wherein the area distribution of the chamber along its axis changes from a geometric figure to a point.

12. A method in accordance with claim 2 including using a pre-shaped specimen whose length is substantially greater than its transverse dimensions, moving said movable wall at a speed which is sufficiently slow so as to cause the specimen to exhibit squirming instability as it increases in transverse dimensions, and step (a) being performed in a manner so that steps (c) and (d) produce a specimen whose hardness varies along this length in a predetermined range.

13. A method in accordance with claim 12 wherein the steps (c) and (d) are applied in a manner so as to cause buckling of the specimen and produce an article at the end of the compressive stroke which has a predetermined hardness at a predetermined location.

* * * * *